United States Patent [19]

Stinar et al.

[11] Patent Number: 5,003,801

[45] Date of Patent: Apr. 2, 1991

[54] PROGRAMMABLE KEY AND IMPROVED LOCK ASSEMBLY

[75] Inventors: Robert P. Stinar, Plymouth; George T. Calvas, Dearborn; David A. McNamara, Saline, all of Mich.

[73] Assignee: Ford Motor Company, Dearborn, Mich.

[21] Appl. No.: 5,070

[22] Filed: Jan. 20, 1987

[51] Int. Cl.[5] ..... E05B 47/00

[52] U.S. Cl. ..... 70/278; 70/408

[58] Field of Search ..... 70/DIG. 46, 277–279, 70/390, 393, 394, 402, 405, 408

[56] References Cited

U.S. PATENT DOCUMENTS

| | | | |
|---|---|---|---|
| 2,105,304 | 1/1938 | Wagner | 70/393 |
| 3,136,307 | 6/1964 | Richard | 70/277 |
| 3,283,550 | 11/1966 | Bradway | 70/277 |
| 3,347,072 | 10/1967 | Rose | /0/277 |
| 3,392,559 | 7/1968 | Hedin et al. | 70/277 |
| 3,599,454 | 8/1971 | Hill et al. | 70/265 |
| 3,639,906 | 2/1972 | Tritach | 70/277 X |
| 3,660,624 | 5/1972 | Bell | 70/DIG. 46 X |
| 3,660,831 | 5/1972 | Nicola et al. | 70/277 X |
| 4,148,372 | 4/1979 | Schroeder | 70/DIG. 46 X |
| 4,176,782 | 12/1979 | Fukuda et al. | 70/271 X |
| 4,192,400 | 3/1980 | McEwan | 70/DIG. 46 X |
| 4,200,227 | 4/1980 | Lemelson | 70/336 X |
| 4,205,325 | 5/1980 | Haygood et al. | 340/147 |
| 4,250,533 | 2/1981 | Nelson | 70/278 X |
| 4,267,494 | 5/1981 | Matsuoka et al. | 318/568 |
| 4,291,237 | 9/1981 | Kitano | 307/10 AT |
| 4,297,569 | 10/1981 | Flies | 70/283 X |
| 4,298,792 | 11/1981 | Granholm et al. | 70/271 X |
| 4,326,125 | 4/1982 | Flies | 70/277 X |
| 4,327,353 | 4/1982 | Beard et al. | 340/64 |
| 4,366,466 | 12/1982 | Lutz | 340/64 |
| 4,415,893 | 11/1983 | Roland et al. | 340/825.31 |
| 4,420,794 | 12/1983 | Anderson | 70/DIG. 46 |
| 4,435,649 | 3/1984 | Vandigriff | 307/10 AT |
| 4,436,993 | 3/1984 | Flies | 235/382 |
| 4,438,426 | 3/1984 | Adkins | 340/64 |
| 4,507,944 | 4/1985 | Widen et al. | 70/278 X |
| 4,663,952 | 5/1987 | Gelhard | 70/278 |
| 4,712,398 | 12/1987 | Clarkson et al. | 70/278 X |

FOREIGN PATENT DOCUMENTS

| | | | |
|---|---|---|---|
| 0065182 | 11/1982 | European Pat. Off. | 70/277 |
| 2739062 | 3/1978 | Fed. Rep. of Germany | 70/408 |
| 2828336 | 1/1980 | Fed. Rep. of Germany | 70/278 |
| 1380749 | 10/1964 | France | 70/277 |
| 2363837 | 3/1978 | France | 70/DIG. 46 |
| 1401281 | 7/1975 | United Kingdom | 70/277 |
| 87/00234 | 1/1987 | World Int. Prop. O. | 70/278 |

*Primary Examiner*—Gary L. Smith
*Assistant Examiner*—Suzanne L. Dino
*Attorney, Agent, or Firm*—Paul K. Godwin, Jr.; Clifford L. Sadler

[57] ABSTRACT

An improved key and lock assembly in which an electronically coded circuit is embedded in the handle of a conventional key and at least one electrical terminal extends from the handle adjacent to and electrically isolated from the key shank so as to contact a similarly located and biased terminal on the lock assembly when the key is fully inserted therein.

8 Claims, 2 Drawing Sheets

PROGRAMMABLE KEY AND IMPROVED LOCK ASSEMBLY

BACKGROUND OF THE INVENTION

1. Field of the Invention

The present inventions relates to the field of security devices and more specifically to the area of key locks.

2. Description of the Prior Art

Recently, several concepts have been patented in which a conventional tumbler actuating key is combined with an auxiliary coding mechanism in order to provide a higher degree of security by increasing the number of codes beyond those available on conventional tumbler actuated keys.

In U.S. Pat. No. 4,200,227, a conventional tumbler actuating key is described as containing a coded electrical circuit that is responsive to short wave radiation. The circuit is embedded within a plastic assembly that is welded or otherwise bonded to the key handle so that the electrical circuit is isolated away from the surface of the key.

In U.S. Pat. No. 4,298,792, a conventional key is shown as containing a coded track along its shank. The key is shown to contain a single code track composed of alternating light and dark fields that are read by sensors in the vicinity of the receiving aperture of the lock. The sensors read the track as the key is inserted into the lock.

In U.S. Pat. No. 4,366,466, the use of a conventional key is described, which additionally includes a housing for a data carrier. The data carrier is described as containing information on, for example, a recording tape, a recording wire, an optically scannable medium or other conventional medium. The data carrier is further said to include either an unerasable portion containing data reflecting vehicle-related information or an erasable portion containing arbitrary information.

SUMMARY OF THE INVENTION

The present invention is considered an improvement over the prior art keys. It utilizes a tumbler actuatable shank cut to correspond to the unlocking tumbler configuration of a corresponding lock. The handle portion of the key contains an electrical terminal extending therefrom so as to be adjacent and electrically isolated with respect to the shank. An electrical coding circuit is embedded within the handle and connected to the electrical terminal adjacent the shank. In the described embodiment, the key shank serves as one electrical terminal connected to the electrical coding circuit within the key handle and two electrical terminals are shown to extend from each side of the handle adjacent the shank. The two electrical terminals adjacent the shank are commonly connected within the handle so that the key may be inserted into the lock in either of two orientations for a double cut key.

The lock mechanism is further improved to include a biased electrical terminal configured to mate with the electrical terminal extending from the handle on the key and electrical conductors to provide interconnection between the biased electrical terminal and an connector for communication to the security system control module (not shown) of the vehicle.

DETAILED DESCRIPTION OF THE PREFERRED EMBODIMENT

Figure 1:
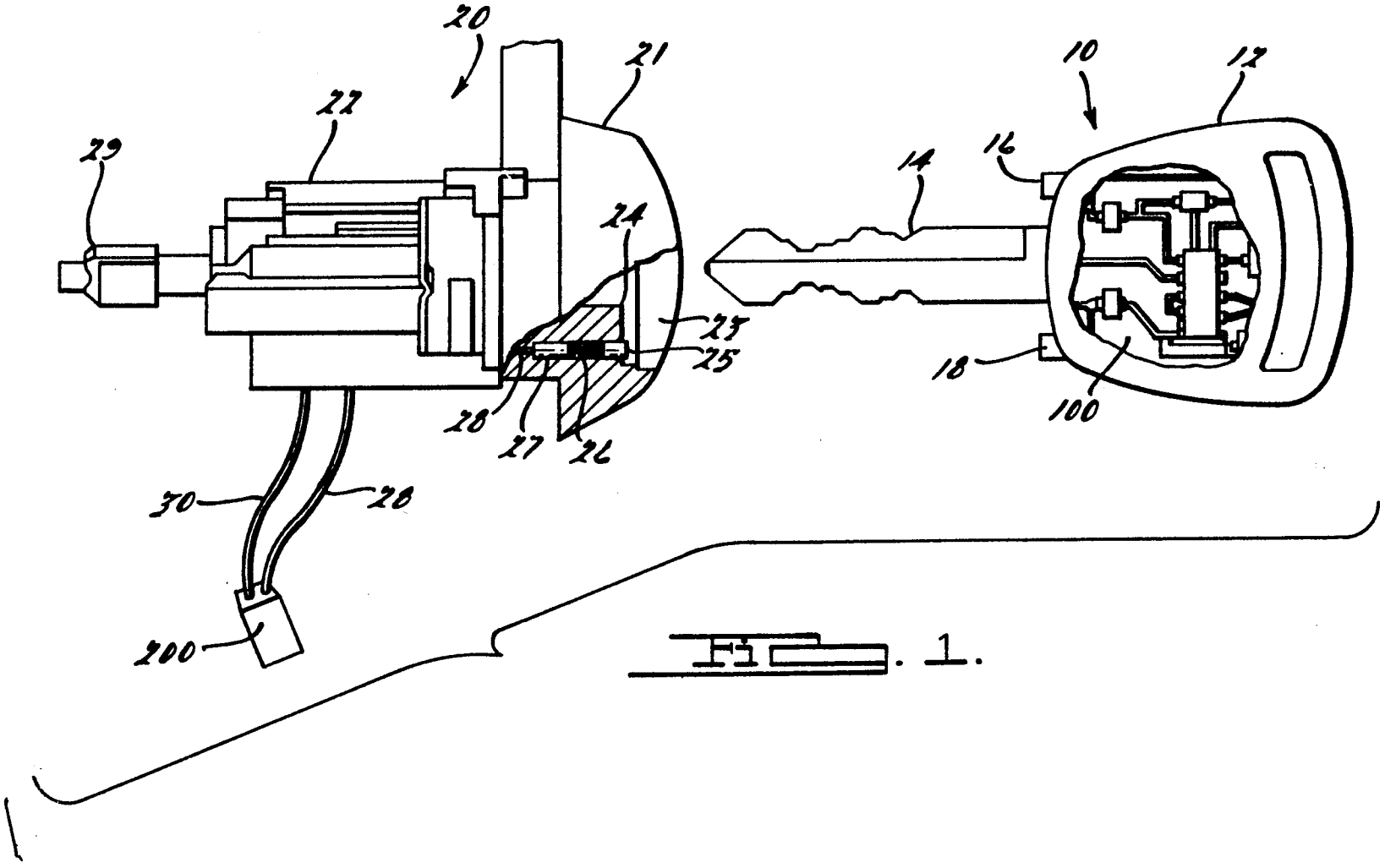
FIG. 1 illustrates the preferred embodiment of the key and lock assembly of the present invention.

In FIG. 1, the improved key 10 and the improved lock assembly 20, which embody the present invention, are illustrated. The key 10 includes a conventional cut shank 14 preferably of steel or brass in a double cut pattern. A handle portion 12 is formed at the upper end of the shank 14 and contains an electronically coded circuit 100 embedded therein. Electrical terminals 16 and 18 are shown provided as extending from the handle 12 adjacent to and electrically isolated from the shank 14.

The lock assembly 20 includes an electrically isolated receptacle end 21 with an aperture 24 and an opening 23 for receiving the shank 14 of the key 10 when inserted therein. Provided the cuts on the shank 14 conform to the tumbler arrangement within the lock mechanism 20, the shank 14 will continue to be inserted fully into the body 22 of the lock 20. Upon full insertion, the electrical terminal 16 and 18, as well as the leading edge of the handle 12 will be received into the opening 23. If the key is inserted as shown in FIG. 1, electrical terminal 18 will contact a biased electrical terminal 25 extending from the isolated portion 21 of the lock 20. The electrical terminal 25 is biased through a conducting spring 26 and is in electrical connection with a fixed terminal end 27 and a conductor 28. The end of the conductor 28 is shown terminated into a conventional electrical connector 200. The body 22 of the lock mechanism 20 is preferably formed of a conducting metal and provides intimate electrical contact with the shank 14 of the key 10 when it is properly inserted. The lead wire 30 provides a ground connection between the body 22 and the connector 200.

A mechanical actuator 29 is shown extending from the body 22 on a shaft and is typical in mechanical locks of this type to provide mechanical connection to other mechanical or electrical actuated devices In an automotive vehicle, the actuator 29 is typically connected to an ignition switch and a mechanism for freeing the steering column prior to start up.

Although not shown in this application, the purpose of the improved key assembly shown in FIG. 1 is to provide additional security so that an associated anti-theft control system within the vehicle will interrogate the electronics of the key to verify that the key is actually the one intended for the same vehicle prior to enabling the start circuit for vehicle operation.

Figure 2:
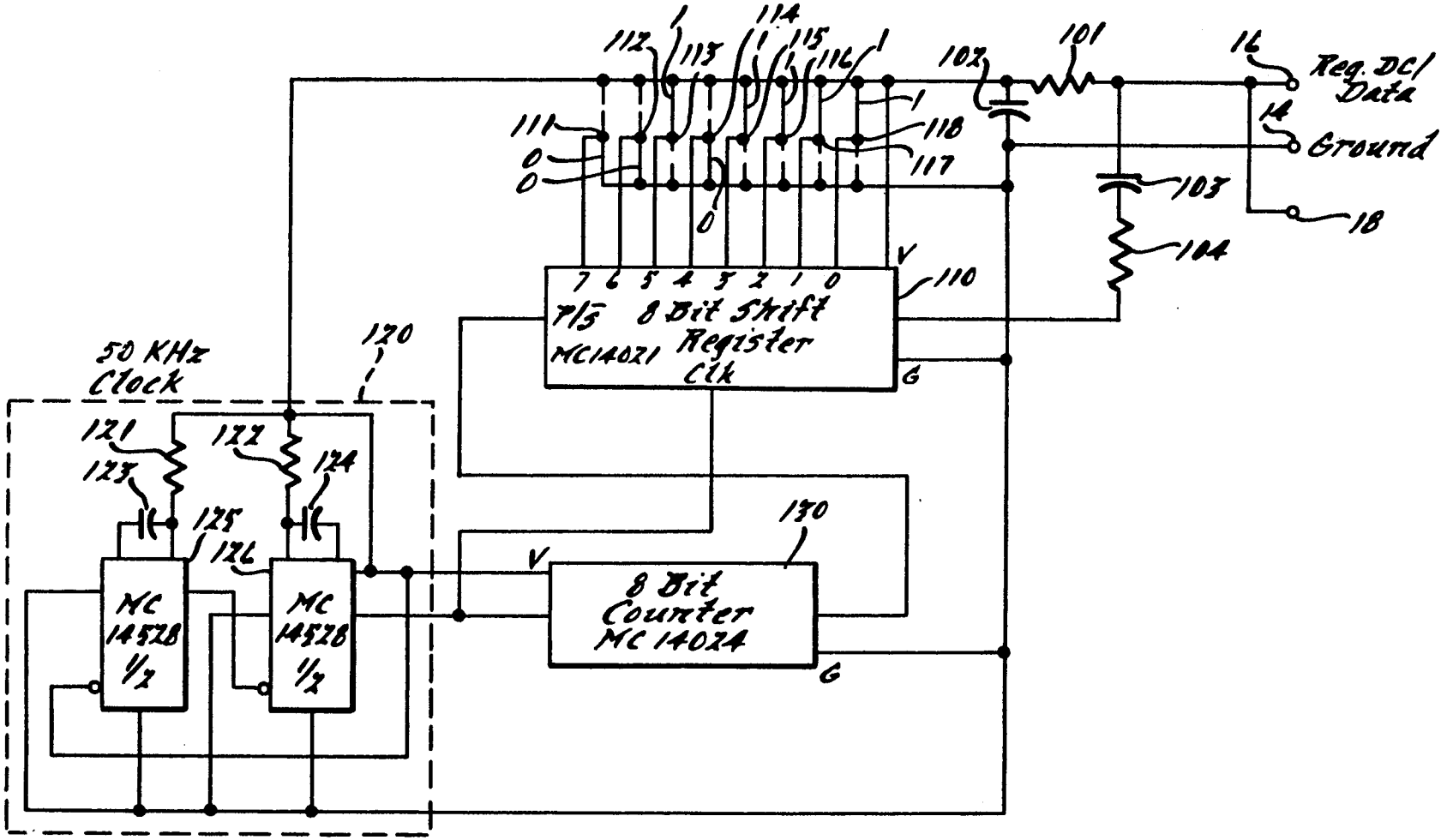
FIG. 2 is a circuit diagram of the electronic coding circuit within the handle of the key of the present invention.

FIG. 2 is an embodiment of the circuit 100 embedded within the handle 12 of the key 10. The circuit comprises a 10 KHz clock circuit 120, and 8-bit shift register 110, an 8-bit counter 130 and a permanently coded element formed by conductors 111–118.

The 50 KHz clock 120 responds to a regulated DC input (5–10 volts) at either terminal 16 or 18 via the spring biased terminal 25 on the lock 20 when fully inserted therein. The DC input is also regulated by the resistor 101 and capacitor 102 which serve to isolate the clock circuit 120 from data modulations that are placed on the DC power line. The clock circuit 120 is also connected to ground through the key shank 14 when the key is inserted into the grounded lock assembly 20. Two multivibrator circuits 125 and 126 are interconnected to provide oscillation in response to the application of the DC input signal. Capacitors 123 and 124 are selected along with resistors 121 and 122 to provide appropriate RC time constants that determine the frequency and duty cycle of the clock signal. While Applicants have selected 10 KHz as the output frequency, it should be noted that the frequency is not critical to operation of the invention but is selected to synchronize with the security system module for reading the output signal from the key.

The permanently coded portion of the circuit is shown as made up of printed circuit conductors 111–118 initially interconnected between the 5 volt power bus and ground. Subsequently, but prior to permanent encapsulation within the handle of the key, the conductors are randomly cut so that the potential present on the conductors is either 5 volts or ground. In the example shown in FIG. 2, the cuts in the conductors result in the code 00101111 present at the I/O ports 0–7 of the 8-bit shift register 110. If the least significant bit of the code is always "1", $2^7$ code possibilities are available for selection.

In operation, when the key is inserted into the lock 20 the shank is held to ground potential and 5 volts DC is supplied to either electrical terminal 16 or 18, depending upon orientation of the key. The 10 KHz clock 120 responds to the applied potential to produce pulses which are input to both the "Clk" terminals of the 8-bit shift register 110 and the 8-bit counter 130. After each eight clock pulses, the counter 130 outputs a signal to the "p/s" terminal of the 8-bit shift register 110 which causes the shift register to read the input voltages available at the coded conductors connected to the I/O ports 0–7. Subsequent clock signals on the Clk terminal of the register 110 cause the eight voltage levels read at I/O ports 0–7 to be sequentially output as a binary bit stream. The output from the 8-bit shift register is provided to resistor 104 and through coupling capacitor 103 to modulate the 5 volt signal on the electrical terminal 16 and 18. In this manner, the 8 bit code is sequentially clocked back through the conductor 25 of the lock assembly 20 and conveyed through the electrical connector 200 to the associated security system control module.

While the aforementioned circuit includes a coded device in the form of cut conductors on a printed circuit board, it is invisioned that electrically programmable or other nonvolatile memory devices may be employed where economy or performance requirements dictate.

It will be apparent that many modifications and variations may be implemented without departing from the scope of the novel concept of this invention. Therefore, it is intended by the appended claims to cover all such modifications and variations which fall within the true spirit and scope of the invention.

We claim:

1. An improved key for use in a security system which utilizes a tumbler movable lock which is unlocked by the insertions of a key shank cut to correspond to the unlocked tumbler configuration and contains at least one electrical lock terminal for making electrical contact with said key and for supplying electrical power to said key, wherein the improved key comprises:

a handle portion connected to said shank and sized for manual gripping of the key;

at least one electrical key terminal extending from said handle portion adjacent to and electrically isolated from said shank for making electrical contact with said electrical lock terminal;

means within said handle portion and connected to said at least one electrical key terminal for receiving said electrical power from said lock and providing a predetermined digital code signal to said electrical key terminal.

2. An improved key as ian claim 1, wherein said key shank is electrically conductive and electrically connected to said code providing means.

3. An improved key as in claim 2, including a pair of electrical key terminals extending from said handle on either side of said shank, electrically isolated from said shank and commonly connected to each other.

4. An improved key as ian claim 3, wherein said pair of electrical key terminals are commonly connected to each other through said code signal providing means.

5. An improved key as in claims 2 or 3, wherein said code signal providing means contains circuitry that is responsive to an electrical potential applied between said key shank and at least one of said electrical key terminals to provide a digital output signal having a predetermined bit code.

6. An improved key as in claim 5, wherein said code signal providing means includes an oscillator circuit which outputs clocking pulses at a predetermined rate in response to the application of said electrical potential, storage means for permanently storing a predetermined bit code, and means connected to said oscillator circuit and said storage means for periodically reading said predetermined bit code in said storage means and sequentially outputting individual bits of the read predetermined bit code in response to each clocking pulse.

7. An improved key as in claim 6, wherein said reading and outputting means provides said digital output signal in the form of individual bits to at least one of said electrical key terminals.

8. An improved key as in claim 7, wherein said handle is formed of a molded insulating material that encapsulates said code providing means.

* * * * *

UNITED STATES PATENT AND TRADEMARK OFFICE

CERTIFICATE OF CORRECTION

PATENT NO. : 5,003,801
DATED : April 2, 1991
INVENTOR(S) Robert P. Stinar, et. al.

It is certified that error appears in the above-indentified patent and that said Letters Patent is hereby corrected as shown below:

Title page, item [75] Inventors: should be Robert P. Stinar, Plymouth; George T. Calvas, Dearborn; David A. McNamara, Saline; Mark S. Bilicki, Sterling Heights, all of Mich.

Signed and Sealed this

Twenty-second Day of February, 1994

*Attest:*

*Attesting Officer*

BRUCE LEHMAN

*Commissioner of Patents and Trademarks*